US006131967A

United States Patent [19]

Kondo et al.

[11] Patent Number: 6,131,967

[45] Date of Patent: Oct. 17, 2000

[54] DOOR LOCK ASSEMBLY FOR AUTOMOTIVE VEHICLES

[75] Inventors: Ichiro Kondo, Anjyo; Hiroshi Ishihara, Toyoake; Toshitsugu Oda, Okazaki, all of Japan

[73] Assignee: Aisin Seiki Kabushiki Kaisha, Kariya, Japan

[21] Appl. No.: 09/244,460

[22] Filed: Feb. 4, 1999

[30] Foreign Application Priority Data

Feb. 9, 1998 [JP] Japan ..... 10-027557

[51] Int. Cl.[7] ..... E05C 3/06

[52] U.S. Cl. ..... 292/201; 292/216; 292/DIG. 23

[58] Field of Search ..... 292/201, 216, 292/DIG. 23, DIG. 27

[56] References Cited

U.S. PATENT DOCUMENTS

| | | | |
|---|---|---|---|
| 4,395,064 | 7/1983 | Bellot et al. | 292/201 |
| 4,667,991 | 5/1987 | Pebre | 292/201 |
| 4,762,348 | 8/1988 | Matsumoto | 292/201 |
| 4,843,849 | 7/1989 | Kamke et al. | 70/264 |
| 4,927,204 | 5/1990 | Asada | 292/216 |
| 5,423,582 | 6/1995 | Kleefeldt | 292/201 |
| 5,466,021 | 11/1995 | Ishihara et al. | 292/201 |
| 5,516,164 | 5/1996 | Kobayashi | 292/201 |
| 5,564,761 | 10/1996 | Mizuki et al. | 292/201 |
| 5,639,130 | 6/1997 | Rogers, Jr. et al. | 292/116 |
| 5,680,783 | 10/1997 | Kuroda | 70/277 |
| 5,938,251 | 8/1999 | Watanabe | 292/201 |

FOREIGN PATENT DOCUMENTS

| | | |
|---|---|---|
| 6-185251 | 7/1994 | Japan . |
| 6-288131 | 10/1994 | Japan . |
| 7-11826 | 1/1995 | Japan . |
| 7-71151 | 3/1995 | Japan . |

*Primary Examiner*—Anthony Knight
*Assistant Examiner*—Clifford B Vaterlaus
*Attorney, Agent, or Firm*—Burns, Doane, Swecker & Mathis, LLP

[57] ABSTRACT

A door lock assembly having a reduced size. The door lock assembly comprises: a closer mechanism for bringing a vehicle door from a partially closed state to a completely closed state; a locking/unlocking mechanism for bringing the vehicle door in the completely closed state to a locked state and an unlocked state; and a drive mechanism including a single motor acting as a drive source for actuating the closer mechanism and the locking/unlocking mechanism.

5 Claims, 14 Drawing Sheets

DOOR LOCK ASSEMBLY FOR AUTOMOTIVE VEHICLES

BACKGROUND OF THE INVENTION

The present invention relates to a door lock assembly for automotive vehicles comprising a locking/unlocking mechanism, and a closer mechanism having a single motor for an actuation thereof.

A known door lock assembly for automotive vehicles is disclosed in the specification of Japanese Patent Laid-Open Publication No. Hei 6-288131 (1994), which includes a locking/unlocking mechanism for bringing a vehicle door in a completely closed state into a locked state and an unlocked state, and a closer mechanism for bringing the vehicle door from a partially closed state to the completely closed state.

This prior-art door lock assembly has a first drive mechanism associated with the closer mechanism and including a motor as a drive source for actuating the closer mechanism; and a second drive mechanism associated with the locking/unlocking mechanism and including another motor as a drive source for actuating the locking/unlocking mechanism.

In this conventional assembly, the first drive mechanism is operated to actuate the closer mechanism to bring the vehicle door automatically from the partially closed state to the completely closed state, and the second drive mechanism is operated to actuate the locking/unlocking mechanism to bring the vehicle door automatically into the locked state and the unlocked state.

In the conventional assembly described above, however, the closer mechanism and the locking/unlocking mechanism are individually provided with the first and second drive mechanisms essential to require the two motors, respectively. This construction enlarges the full size of the assembly and requires a large housing space in the vehicle door to set it so that the weight and the cost of the door lock assembly are increased.

SUMMARY OF THE INVENTION

It is, therefore, an object of the invention to reduce the entire size of the door lock assembly.

In order to achieve the above-specified object, according to an aspect of the present invention, there is provided a door lock assembly comprising: a closer mechanism for bringing a vehicle door from a partially closed state to a completely closed state; a locking/unlocking mechanism for bringing the vehicle door in the completely closed state to a locked state and an unlocked state; and a drive mechanism including a single motor acting as a drive source for actuating the closer mechanism and the locking/unlocking mechanism.

According to this technical means, the drive mechanism is so shared for actuating the closer mechanism and the locking/unlocking mechanisms as to include the single motor in the whole assembly. This construction can make the whole assembly smaller than that of the related prior art.

Preferably, the assembly may further comprises a double lock mechanism adapted to be actuated by the drive mechanism for disabling the vehicle door in the locked state to be unlocked from the inside and outside of a vehicle compartment.

More preferably, the drive mechanism includes: a first output lever associated with the locking/unlocking mechanism for reciprocating between a locked position, in which the vehicle door is in the locked state unable to actuate a latch mechanism, and an unlocked position in which the vehicle door is in the unlocked state able to actuate the latch mechanism to open the door; a second output lever associated with the closer mechanism for reciprocating between an initial position and an active position in which the vehicle door is brought from the partially closed state to the completely closed state; and a rotary member for reciprocating the first output lever between the locked position and the unlocked position and for reciprocating the second output lever between the initial position and the active position.

More preferably, the rotary member rotates beyond in a range of a desired angle of rotation, at which the first output lever is at the locked position, to move the second output lever from the initial position to the active position.

More preferably, the rotary member has a groove formed in its outer peripheral face, and the first output lever has an engagement pin formed thereon for coming into and out of engagement with the groove and for coming into abutment against the outer peripheral face when disengaged from the groove.

DESCRIPTION OF THE PREFERRED EMBODIMENT

Figure 1:
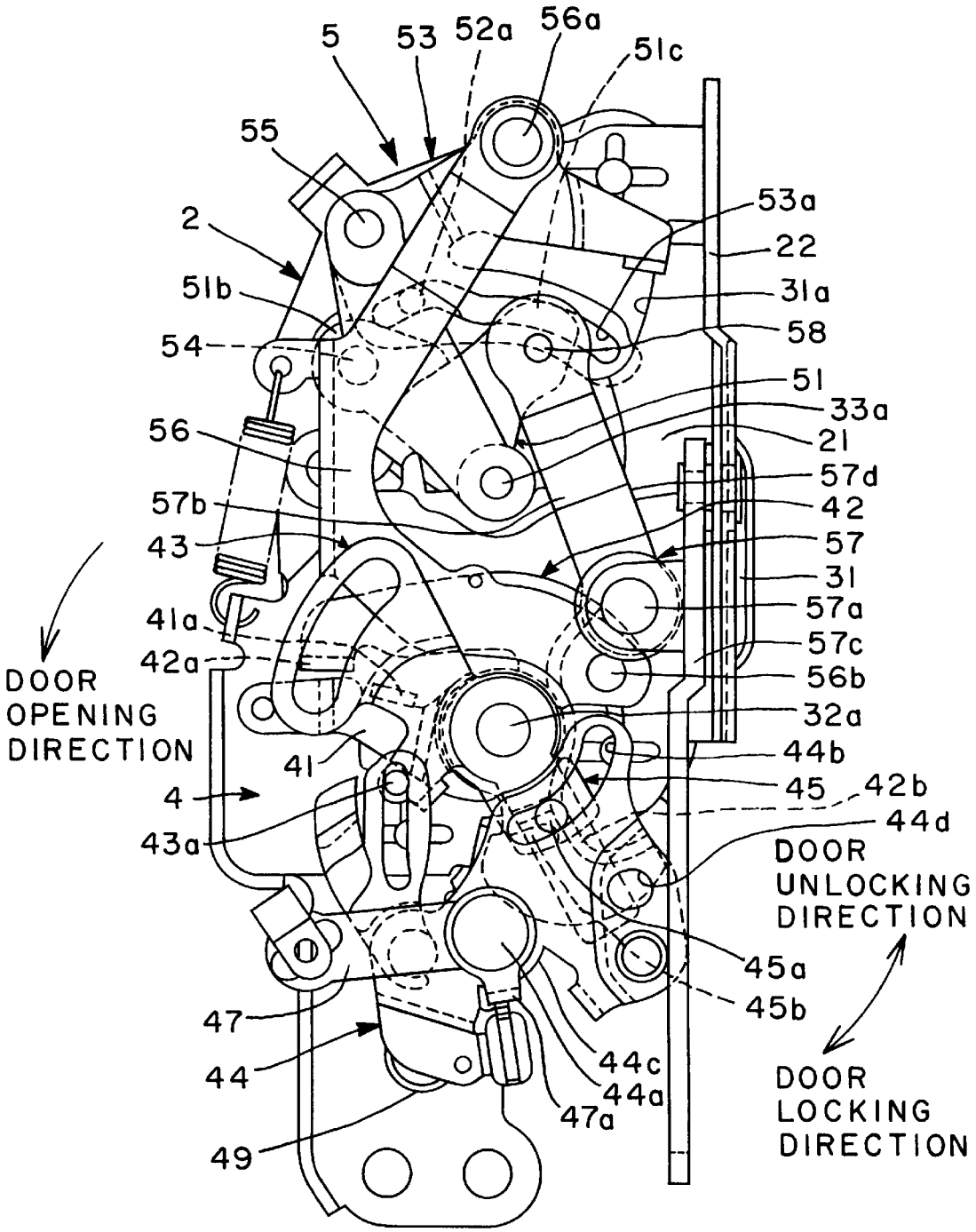
FIG. 1 is a front elevation showing a door lock assembly according to the invention.

As shown in FIGS. 1 to 4, a door lock assembly 1, as adapted to be mounted on a vehicle door (although not shown), is constructed to comprise a base plate 2, a latch mechanism 3, a lever mechanism 4, a closer mechanism 5 and an actuator 6.

As shown in FIG. 1, the base plate 2 is formed into an L-shape having a horizontal wall 21 and a vertical wall 22.

Figure 2:
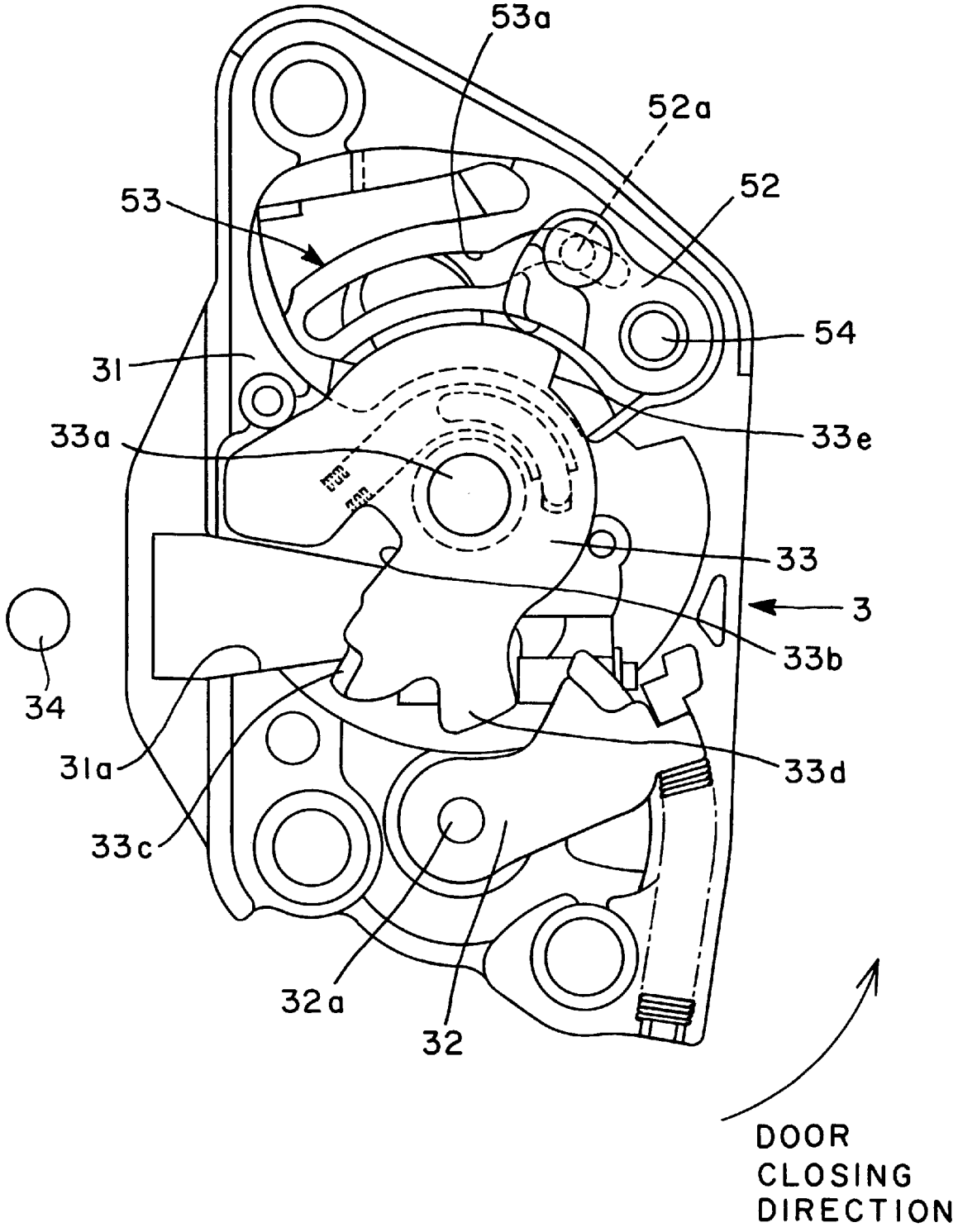
FIG. 2 is a back elevation of FIG. 1 showing a latch mechanism of the door lock assembly according to the invention.

As shown in FIG. 2, the latch mechanism 3 is constructed to include mainly a pawl 32 and a latch 33.

The pawl 32 and the latch 33 are housed in a body 31, as fixed on the horizontal wall 21 of the base plate 2, and are turnably supported on the body 31 through pins 32*a* and 33*a*, respectively. In the body 31, on the other hand, there is formed an insert groove 31*a* for inserting thereinto a striker 34 mounted on the (not-shown) body of the vehicle in response to the opening/closing operations of the vehicle door.

At the peripheral wall of the latch 33, there are formed a U-shaped groove 33*b* for receiving the striker 34 which enters at the insert groove 31*a* of the body 31, and first and second engagement teeth 33*c* and 33*d* for coming into and out of engagement with the pawl 32. This pawl 32 comes, when turned, into engagement with the first and second engagement teeth 33*c* and 33*d* of the latch 33. With the pawl 32 and the latch 33 thus constructed, the vehicle door is kept in a completely closed state when the pawl 32 and the first engagement tooth 33*c* of the latch 33 engage so that the turn of the latch 33 is regulated by the pawl 32 while the striker 34 being received in the U-shaped groove 33*b* of the latch 33. The vehicle door is kept in a partially closed state when the pawl 32 and the second engagement tooth 33*d* of the latch 33 engage so that the turn of the latch 33 is regulated by the pawl 32 while the striker 34 being received in the U-shaped groove 33*b* of the latch 33. On the other hand, the vehicle door is brought into an open state when the pawl 32 is turned to disengage from the first and second engagement teeth 33*c* and 33*d* of the latch 33.

As shown in FIG. 1, the lever mechanism 4 is constructed to include mainly a first lift lever 41, a second lift lever 42, an open lever 43, a locking lever 44 and a slide bushing 45.

The first lift lever 41 is arranged over the horizontal wall 21 of the base plate 2 and is turnably supported by the pin 32*a* supporting the pawl 32 of the latch mechanism 3. This first lift lever 41 has a fitting flange portion 41*a*, through which it is fitted on the pawl 32 so that it turns integrally with the pawl 32. The second lift lever 42 is arranged like the first lift lever 41 over the horizontal wall 21 and is turnably supported by the pin 32*a*. At one and the other arm portions of the second lift lever 42, respectively, there are engagement flanges 42*a* and 42*b*. Of these, the engagement flange 42*a* comes, when the second lift lever 42 turns counterclockwise (or in the door opening direction) of FIG. 1, into engagement with the first lift lever 41 so that its turn is transmitted to the first lift lever 41.

The open lever 43 is arranged like the first and second lift levers 41 and 42 over the horizontal wall 21 of the base plate 2 and is turnably supported by the pin 32*a* supporting the pawl 32 of the latch mechanism 3. This open lever 43 is connected at its one arm portion an outside handle (although not shown), as disposed on the side of the vehicle door outside of the compartment, through a link (although not shown). On the other hand, a pin portion 43*a* is formed on the open lever 43.

The locking lever 44 is arranged over the horizontal wall 21 of the base plate 2 and is turnably supported on the horizontal wall 21 of the base plate 2 through a pin 44*a*. This locking lever 44 is connected to the (not-shown) lock knob, as disposed on the side of the vehicle door inside of the compartment, through a later-described inside locking lever 46 and is connected to the (not-shown) key cylinder mechanism, as disposed on the side of the vehicle door outside of the compartment, through a later-described key lever 47. In the other arm portion of the locking lever 44, on the other hand, there is formed an arcuate slot 44*b* which is centered around the pin 32*a*.

The slide bushing 45 is slidably supported on the other arm portion of the open lever 43. On this slide bushing 45, there is formed a pin portion 45*a*, which is slidably fitted in the slot 44*b* of the locking lever 44. On the slide bushing 45, on the other hand, there is formed an engagement projection 45*b* which can be brought into and out of engagement with the engagement flange 42*b* of the second lift lever 42 by the turning motion of the open lever 43. The slide bushing 45 thus constructed is slid with respect to the other arm portion of the open lever 43 through the inserted relation between the slot 44*b* and the pin portion 45*a* by the turning motion of the locking lever 44. This may bring the engagement projection 45*b* to and from the engagement locus with the engagement flange 42*b* of the second lift lever 42. As a result, the lever mechanism 4 establishes the locked state and the unlocked state of the vehicle door. In the locked state, the latch mechanism 3 can not be actuated through an operation of a door opening handle and in the unlocked state the latch mechanism 3 can be actuated to open the door through the operation of the door opening handle. Here, the locking lever 44 is urged to keep the locked state and the unlocked state by a turnover spring 49 arranged between the locking lever 44 and the base plate 2.

The key lever 47 is arranged over the surface of the horizontal wall 21 and is turnably supported over the horizontal wall 21 of the base plate 2 by the pin 44*a* supporting the locking lever 44. In this key lever 47, there is formed an engagement projection 47*a*, which is received by a notch 44*c* formed in the locking lever 44. As a result, the turn of the key lever 47 is transmitted to the locking lever 44 through the abutment between the side wall face of the notch 44*c* and the engagement projection 47*a* by the turning of the key lever 47.

As shown in FIGS. 1 and 2, the closer mechanism 5 is constructed to include mainly a close lever 51, a release pawl 52 and a cancel lever 53.

The close lever 51 is arranged in the opening 31*a*, as formed in the body 31 and the horizontal wall 21 of the base plate 2, and is turnably supported by the pin 33*a* supporting the latch 33 is the latch mechanism 3. The close lever 51 has a first arm portion 51*b* and a second arm portion 51*c*.

The release pawl 52 is arranged over the same plane as the latch 33 and is turnably supported on the first arm portion 51*b* of the close lever 51 by a pin 54. On this release pawl 52, there is erected a pin 52*a*. On the outer peripheral face of the latch 33, on the other hand, there is formed a pawl portion 33*e* which can come into and out of engagement with the release pawl 52.

The cancel lever 53 is turnably supported in the vicinity of the opening 31*a* and on the horizontal wall 21 of the base plate 2 by a pin 55. In this cancel lever 53, there is formed an arcuate slot 53*a*, into which the pin 52*a* of the release pawl 52 is movably inserted. As a result, the release pawl 52 is brought into and out of engagement with the engagement locus with the pawl portion 33*e* of the latch 33 through the inserting relation between the slot 53*a* and the pin 52*a* by the turning motion of the cancel lever 53. On the other hand, the cancel lever 53 is connected through a rod 56 to the second lift lever 42 and through an inside lever (although not shown), as turnably supported on the vertical wall 22 of the base plate 2, to the side of the vehicle door inside of the compartment. The rod 56 is hinged to the cancel lever 53 by a pin 56*a* and to the second lift lever 42 by a pin 56*b*. The close lever 51 is connected at its second arm portion 51*c* through a rod 57 to a closing output lever 66 of the actuator 6, as will be described hereinafter. Here, the rod 57 is halved into a first rod 57*b* and a second rod 57*c*, as connected to each other through a pin 57*a*. The first rod 57*b* is hinged to the second arm potion 51*c* by the pin 58, and the second rod 57*c* is hinged to the closing output lever 66. On the other hand, the second rod 57*c* is slidably supported on the vertical wall 22 of the base plate 2 by a pin 57*d*.

Figure 3:
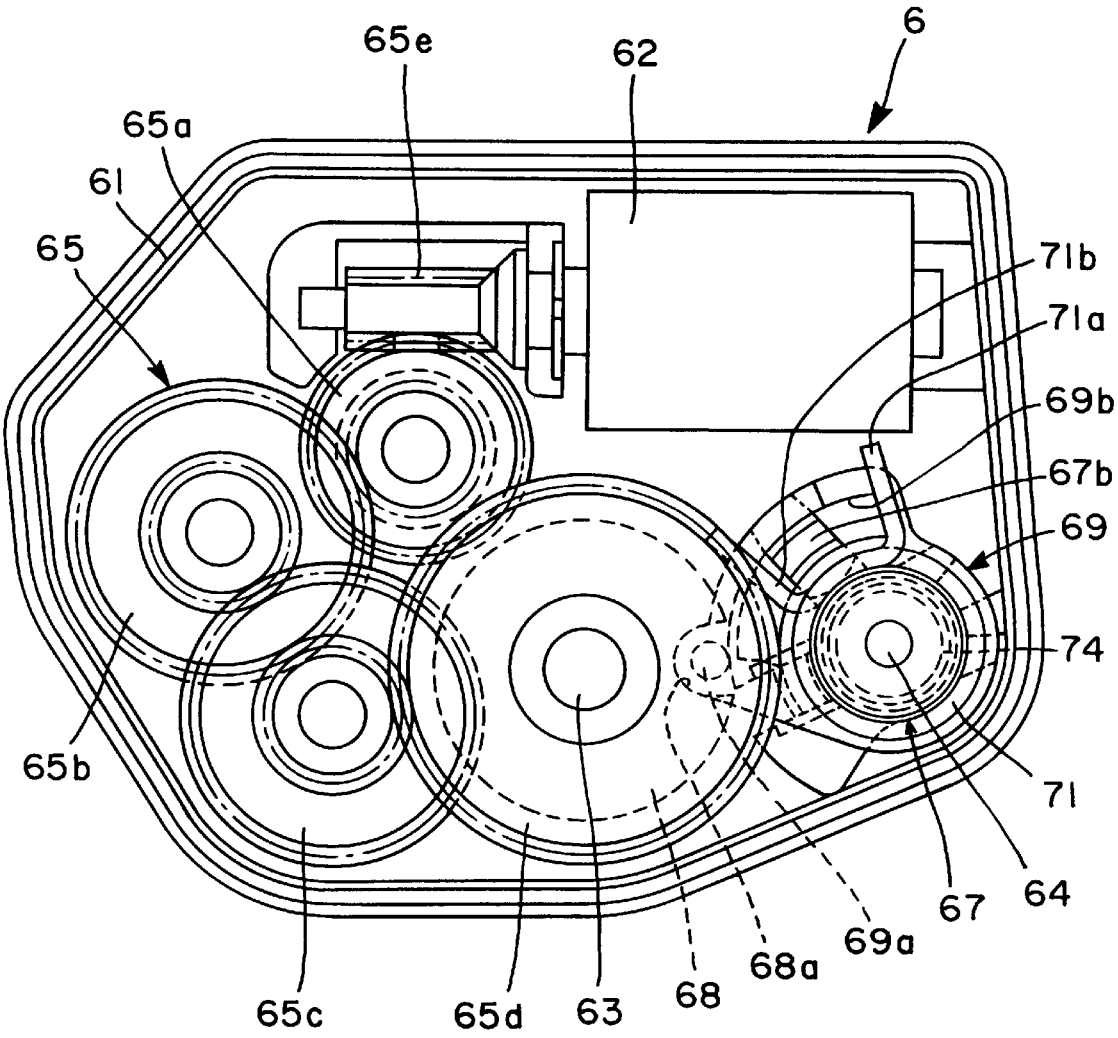
FIG. 3 is a front elevation showing an actuator of the door lock assembly according to the invention.
Figure 4:
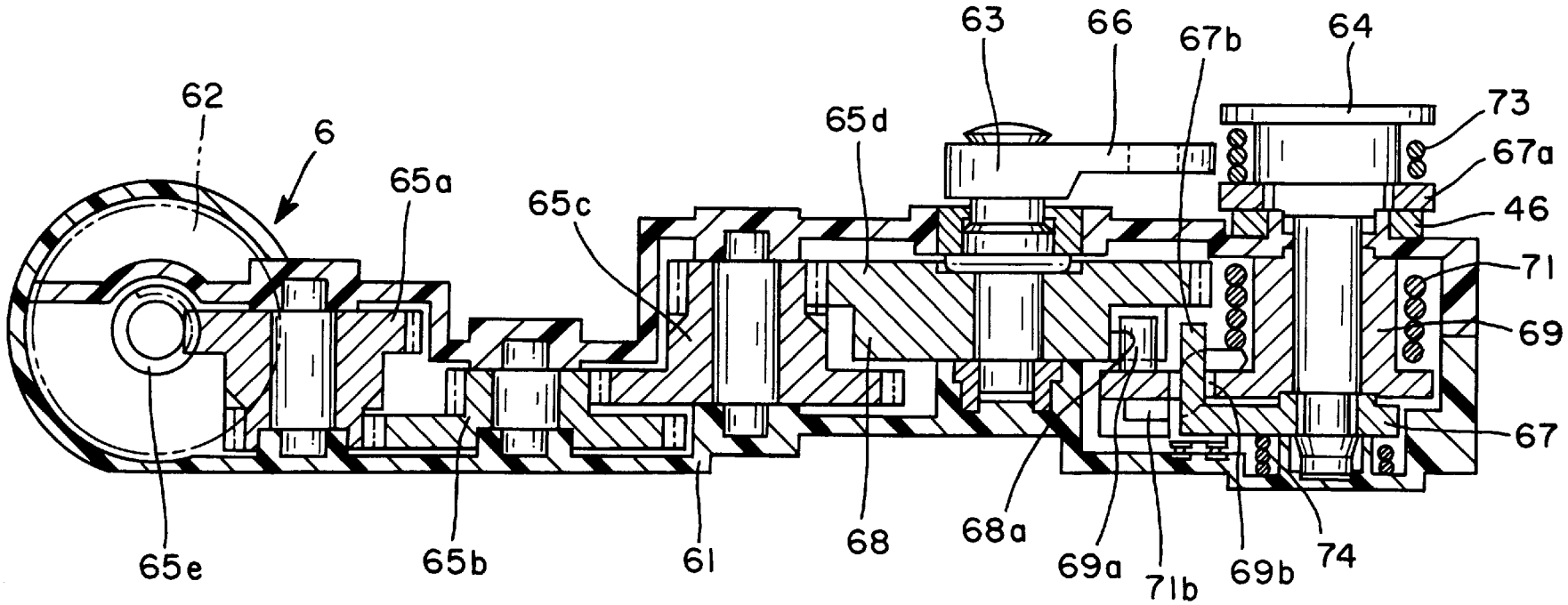
FIG. 4 is a transverse section of FIG. 3.

As shown in FIGS. 3 and 4, the actuator 6 includes a single reversible motor 62 housed in a housing 61 and is supported on the vertical wall 22 (as shown in FIG. 1) of the base plate 2. This actuator 6 is equipped with first and second output shafts 63 and 64 which extend through the housing 61 to the outside. The first output shaft 63 is connected to the motor 62 through a reduction gear structure 65 which includes a plurality of gears 65*a*, 65*b*, 65*c* and 65*d* supported turnably in the housing 61, and a worm gear 65*e* fixed on the rotary shaft of the motor 62. The closing output lever 66 is so fixed on the outer extension of the first output shaft 63 as to turn together, and a locking/unlocking output lever 67 is so fixed on the second output shaft 64 as to turn together. The closing output lever 66 is connected through the rod 57 to the second arm portion 51*c* of the close lever 51, to slide the rod 57 (as shown in FIG. 1) along the vertical wall 22 of the base plate 2 by its turning motion while being guided by the vertical wall 22 thereby to turn the close lever 51. The locking/unlocking output lever 67 is so connected to the locking lever 44 that its fitted portion 67*a* fixed to turn together on the outer extension of the second output shaft 64 is fitted in a through hole 44*d* (as shown in FIG. 1) formed in the locking lever 44, thereby to turn the locking lever 44 by its turning motion.

A cam 68 is formed integrally with the gear 65*d* which is so fixed on the first output shaft 63 as to turn together. A groove 68*a* is formed in the outer peripheral face of the cam 68. An action lever 69 is supported relatively turnably on the second output shaft 64. This action lever 69 is equipped at its leading end with a pin 69*a* for coming into and output of engagement with the groove 68*a* of the cam 68, so that it is turned by the engagement between the pin 69*a* and the groove 68*a* as the cam 68 turns. In the action lever 69, on the other hand, there is formed an arcuate slot 69*b* which is centered around the second output shaft 64. On the locking/unlocking output lever 67, there is formed a flange portion 67*b* which is inserted into the slot 69*b*.

Figure 5:
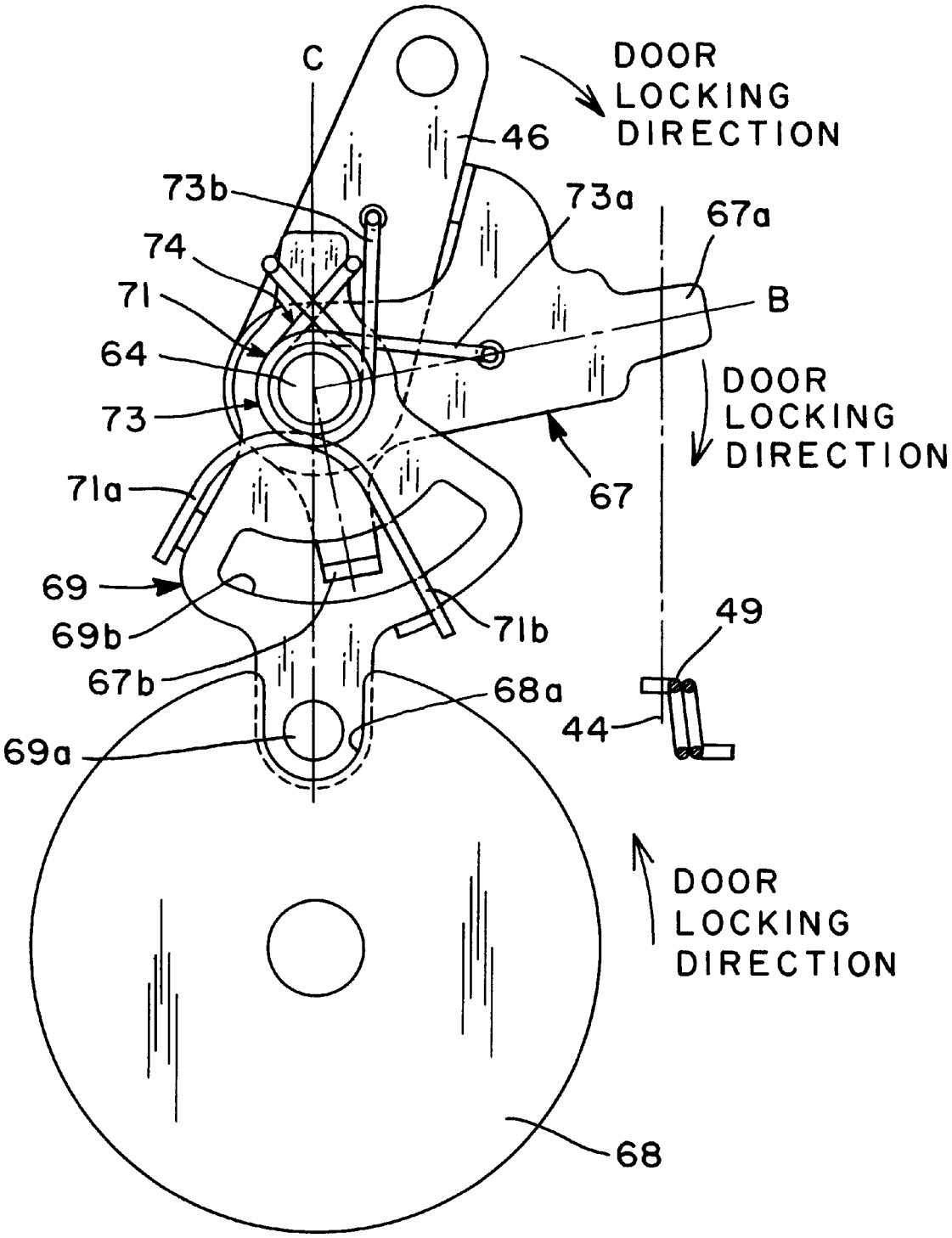
FIG. 5 is an explanatory diagram showing locking/unlocking actions of the door lock assembly according to the invention.
Figure 6:
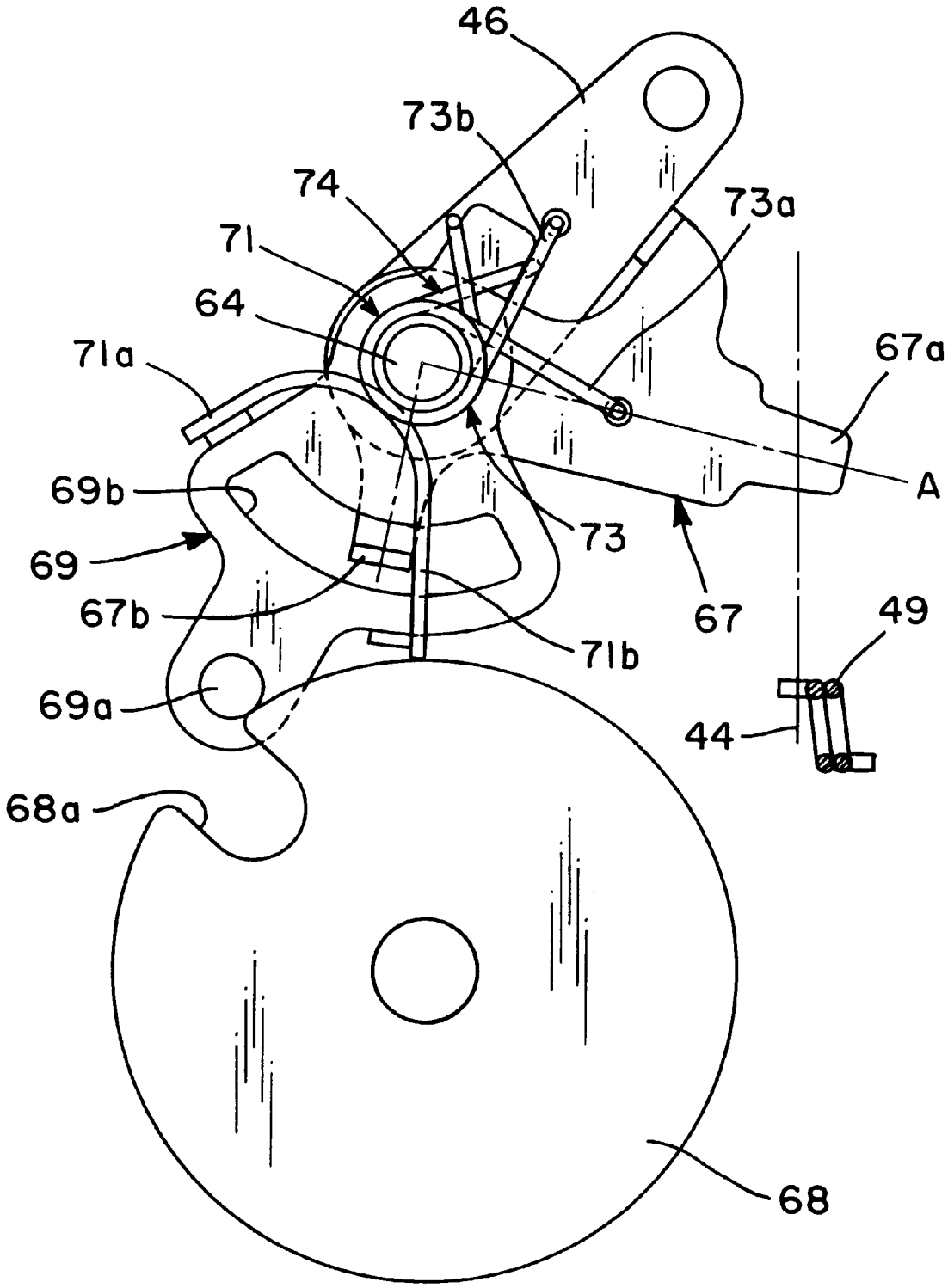
FIG. 6 is an explanatory diagram showing locking/unlocking actions of the door lock assembly according to the invention.

Around the journal of the action lever 69, there is wound a spring 71, one end 71*a* of which is retained on the action lever 69 to generate an urging force, and the other end 71*b* of which is so retained across the slot 69*b* on the action lever 69 to generate the urging force that it can engage with the flange portion 67*b* of the locking/unlocking output lever 67. As a result, the clockwise turning motion, as seen in FIG. 3, of the action lever 69 is transmitted through the contact between the side wall of the slot 69*b* and the flange portion 67*b* to the locking/unlocking output lever 67 so that it turns the locking/unlocking output lever 67 through the locking lever 44 to a locked position A) as shown in FIG. 6), in which the vehicle door is locked. The counter-clockwise turning motion, as seen in FIG. 3, is transmitted through the engagement between the other end of the spring 71 and the flange portion 67*b* to the locking/unlocking output lever 67 so that it turns the locking/unlocking output lever 67 through the locking lever 44 to an unlocked position B (as shown in FIG. 5), in which the vehicle door is unlocked. Here, the action lever 69 for turning the locking/unlocking output lever 67 to the locked position A or the unlocked position B is returned through the cam 68 to a neutral position C by the reverse drive of the motor 62. The urging force of the spring 71 is set stronger than that of the turnover spring 49. Moreover, the other end 71*b* of the spring 71 is enabled by the engagement with the flange portion 67*b* to deform with respect to the retained portion on the action lever 69 by a load no less than its own urging force.

In the housing 61, the inside locking lever 46 is supported relatively rotatably around the second output shaft 64. Around the journal of the inside locking lever 46, there is wound a spring 73, one end 73*a* of which is retained on the locking/unlocking output lever 67 and the other end 73*b* of which is retained on the inside locking lever 46. The urging force of the spring 73 is set stronger than that of the turnover spring 49 and weaker than that of the spring 71.

Around the second output shaft 64, there is wound a spring 74, which acts upon the action lever 69 to keep the contact of the pin 69*a* with the cam 68 at the turning time of the action lever 69.

Here will be described the operations.

Locking/Unlocking of Door

FIG. 1 shows the lever mechanism 4 in the unlocked state of the vehicle door. As shown in FIG. 5, the locking/unlocking output lever 67 is at the unlocked position B, and the action lever 69 is at the neutral position C so that the pin 69*a* engages with the groove 68*a* of the cam 68.

Figure 7:
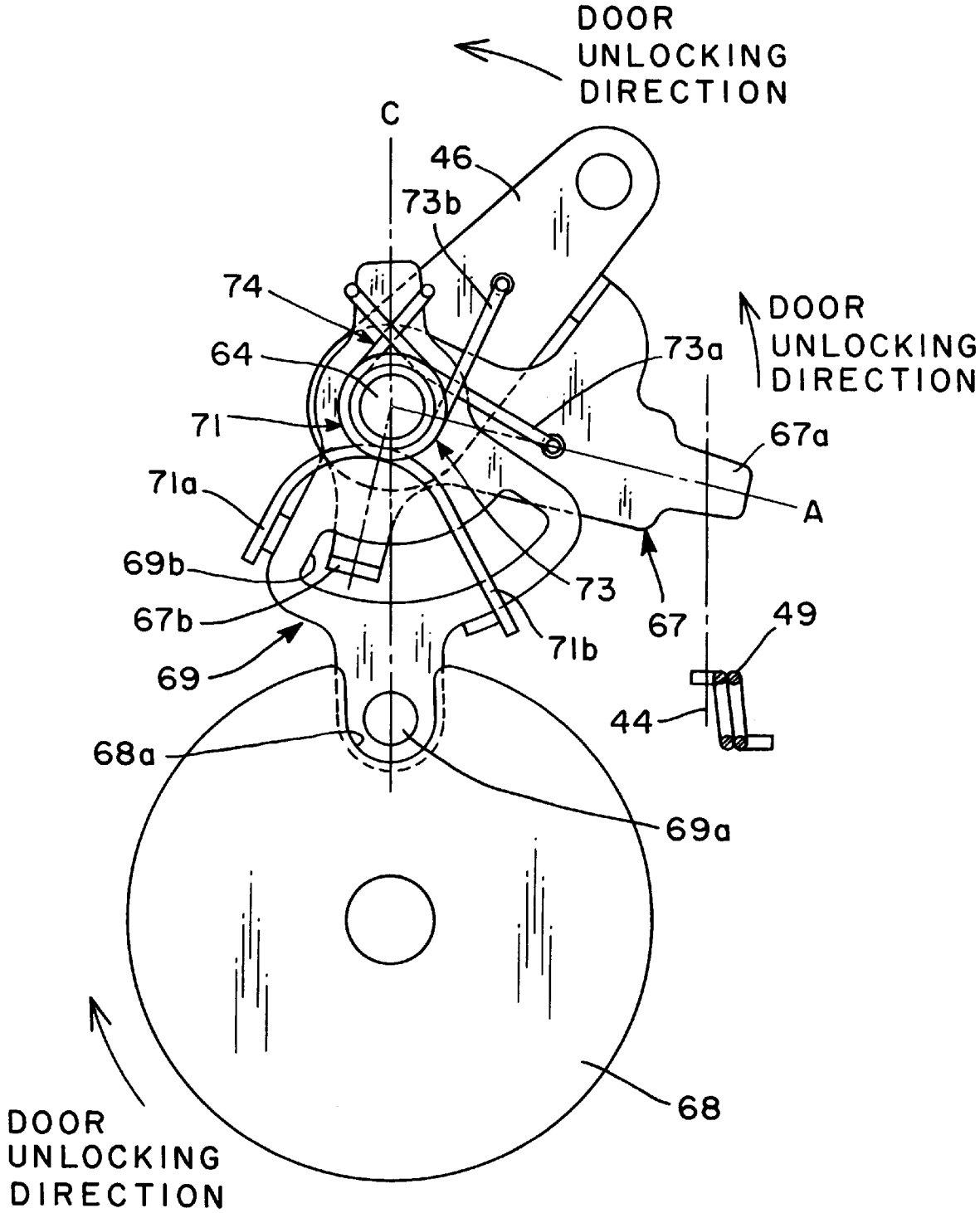
FIG. 7 is an explanatory diagram showing locking/unlocking actions of the door lock assembly according to the invention.
Figure 14:
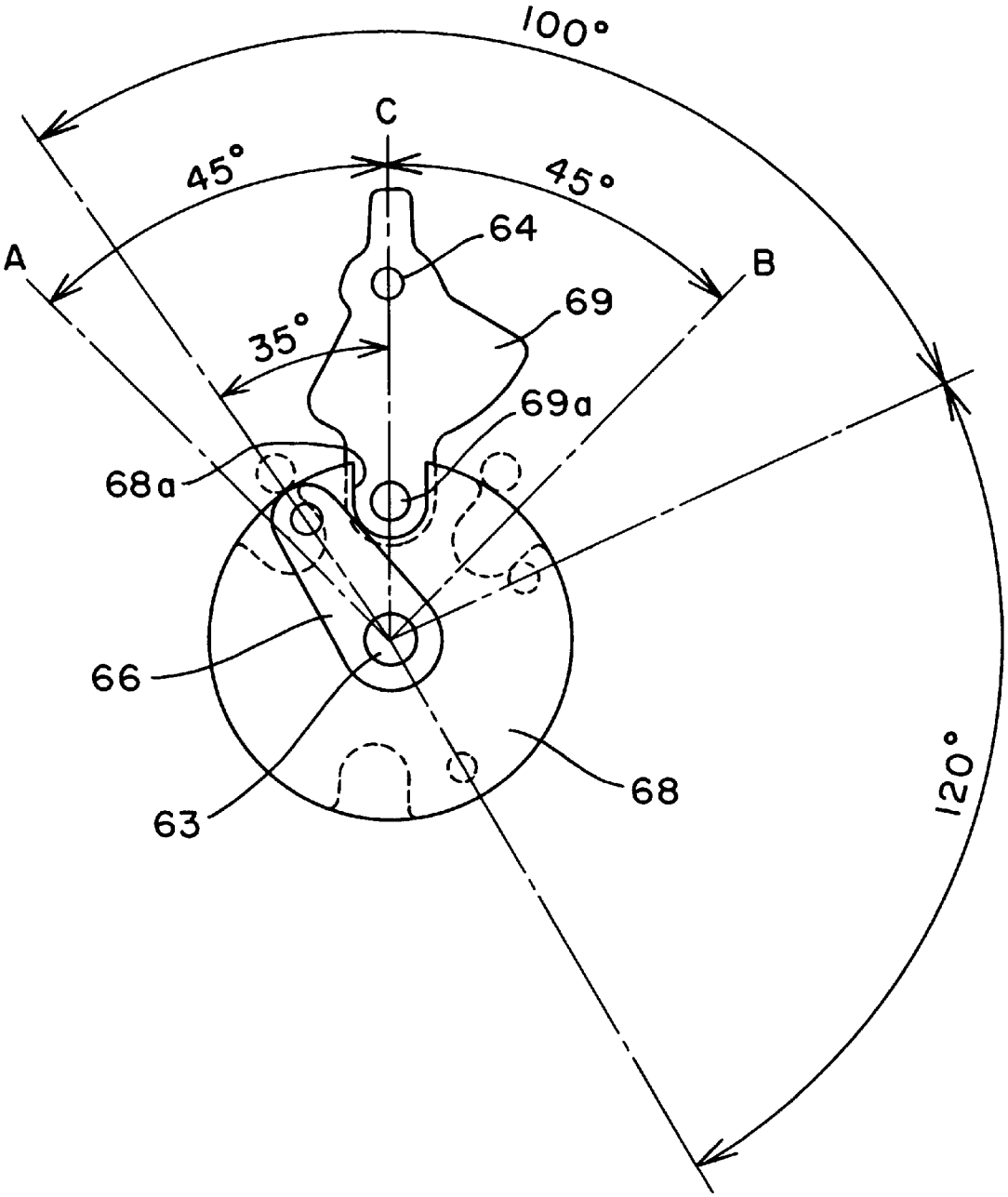
FIG. 14 is an explanatory diagram showing an action angle at the times of the locking/unlocking actions and the closing action of the door lock assembly according to the invention.

In this state, when the motor 62 of the actuator 6 is driven in one direction, the cam 68 turns through the reduction gear structure 65 by a predetermined angle (e.g., counter-clockwise about 45 degrees from the position at which the action lever 69 is at the initial position C, as shown in FIG. 14) counter-clockwise (or in the door locking direction), as seen in FIG. 5. As a result, the pin 69*a* of the action lever 69 is pushed by its engagement with the groove 68*a* of the cam 68 so that the action lever 69 turns clockwise of FIG. 5. By the contact between the other end 71*b* of the spring 71 and the flange portion 67*b* of the locking/unlocking output lever 67, the locking/unlocking output lever 67 is then turned clockwise (or in the door locking direction) of FIG. 5 to the locked position A, as shown in FIG. 6. As a result, the locking lever 44 is turned clockwise (or in the door locking direction) of FIG. 1 and is retained by the turnover spring 49, so that the lever mechanism 4 establishes the locked state of the vehicle door. At this time, the inside locking lever 46 is caused by the urging force of the spring 73 to turn clockwise (or in the door locking direction) of FIG. 5 while following the turning motion of the locking/unlocking output lever 67. On the other hand, the pin 69*a* of the action lever 69 comes out of the groove 68*a* of the cam 68 so that it is positioned on the outer peripheral face of the cam 68 and is disengaged from the groove 68*a*. After this, the motor 62 is reversed to return the action lever 69 to the initial position C, as shown in FIG. 7, so that the pin 69*a* of the action lever 69 restores the engagement with the groove 68*a* of the cam 68. Since the locking/unlocking output lever 67 then receives the urging force of the turnover spring 49 through the locking lever 44, it is retained at the locked position A without any turn following the action lever 69. When the other end 71*b* of the spring 71 and the flange portion 67*b* of the locking/unlocking output lever 67 come into contact, the other end 71*b* of the spring 71 is not warped by the contact with the flange portion 67*b* of the spring 71, but the locking/unlocking output lever 67 is turned without fail, because the urging force of the spring 71 is set stronger than that of the turnover spring 49.

Figure 8:
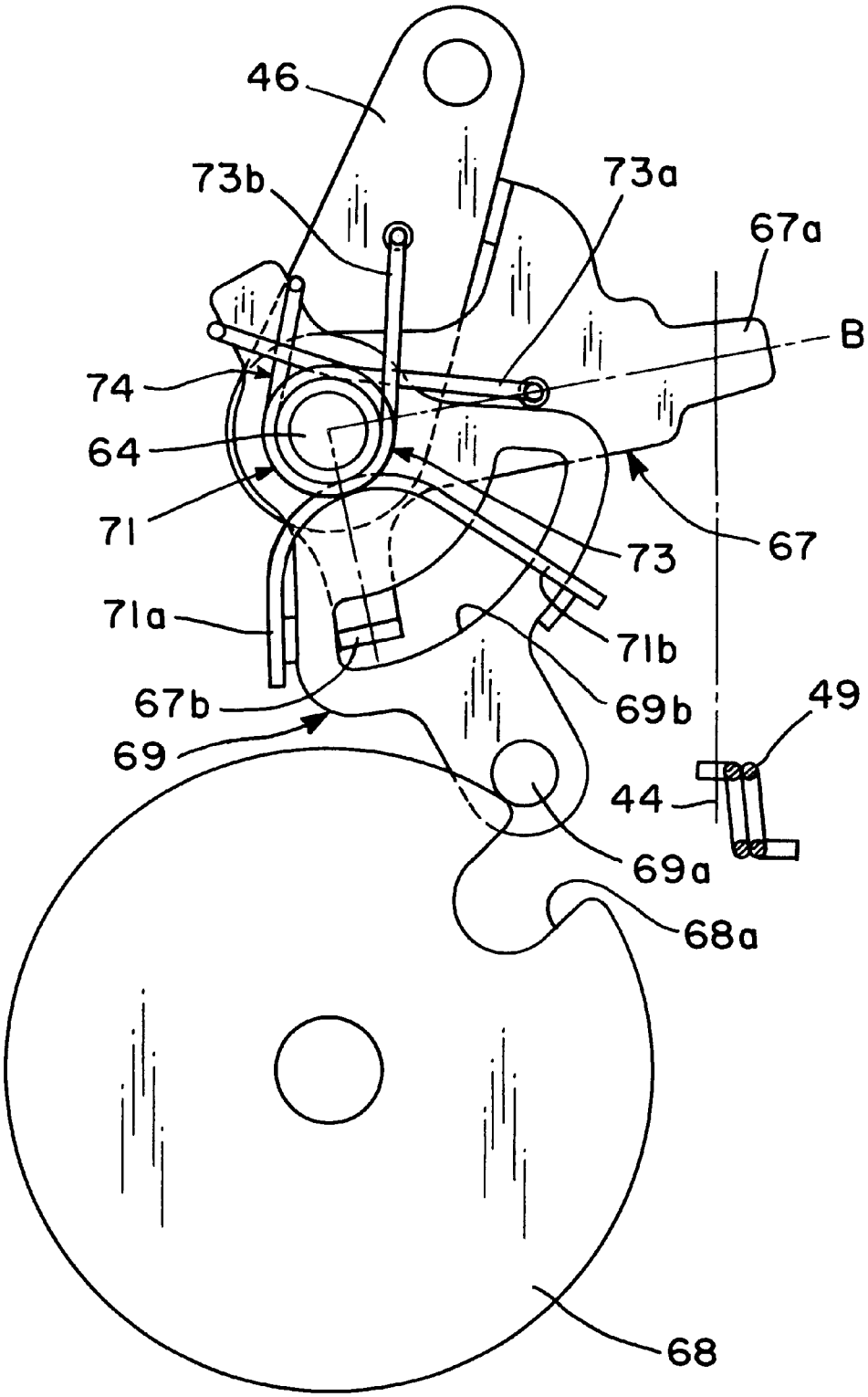
FIG. 8 is an explanatory diagram showing locking/unlocking actions of the door lock assembly according to the invention.

In the locked state of the vehicle door, when the motor 62 is driven in the other direction, the cam 68 is turned by a predetermined angle (e.g., clockwise about 45 degrees from the position at which the action lever 69 is at the initial position C, as shown in FIG. 14) clockwise (or in the door unlocking direction), as seen in FIG. 7, through the reduction gear structure 65. As a result, the pin 69*a* of the action lever 69 is pushed by its engagement with the groove 68*a* of the cam 68 so that the action lever 69 turns counter-clockwise of FIG. 7 from the neutral position C. By the contact between the side wall of the slot 69*b* of the action lever 69 and the flange portion 67*b* of the locking/unlocking output lever 67, the locking/unlocking output lever 67 is then turned counter-clockwise (or in the door unlocking direction) of FIG. 7 to the unlocked position B, as shown in FIG. 8. As a result, the locking lever 44 is turned counter-clockwise (or in the door unlocking direction) of FIG. 1 and is retained in the turnover spring 49 so that the lever mechanism 4 establishes the unlocked state of the vehicle door. After this, the motor 62 is reversed to return the action lever 69 to the initial position C, as shown in FIG. 5. Since the locking/unlocking output lever 67 then receives the urging force of the turnover spring 49 through the locking lever 44, it is retained at the unlocked position B without any turn following the action lever 69. Here, at this unlocking time as in the aforementioned locking action, the inside locking lever 46 is pushed by the locking/unlocking output lever to turn clockwise (or in the door unlocking direction) of FIG. 7 together with the locking/unlocking output lever 67. Before the backward rotation of the motor 62, on the other hand, the pin 69*a* of the action layer 69 goes out of engagement with the groove 68*a* of the cam 68 and is positioned on the outer peripheral face of the cam 68.

The locked state and the unlocked state of the vehicle door by the manual operation of the lock knob can be switched by turning the inside locking lever 46 to turn the locking/unlocking output lever 67 of the actuator 6 in the door locking direction or the door unlocking direction. The turning force at the time when the vehicle door is changed from the locked state to the unlocked state is transmitted from the inside locking lever 46 to the locking/unlocking output lever 67 such that the locking/unlocking output lever 67 is caused to follow the turning motion of the inside locking lever 46 by the urging force of the spring 73. The turning force at the time when the vehicle door is changed from the unlocked state to the locked state is transmitted from the inside locking lever 46 to the locking/unlocking output lever 67 such that the inside locking lever 46 pushes the locking/unlocking output lever 67. At this time, the action lever 69 is positioned at the neutral position C to obstruct no turning motion of the locking/unlocking output lever 67. Here, the urging force of the spring 73 is set stronger than that of the turnover spring 49 so that the transmission of the turning force by the spring 73 is ensured.

The locked state and the unlocked state of the vehicle door by the action of the key cylinder mechanism can be switched by tuning the key lever 47 to turn the locking lever 44 directly in the door locking direction and the door unlocking direction. At this time, the locking/unlocking output lever 67 of the actuator 6 is turned by the turning motion of the locking lever 44, but the action lever 69 is in the neutral position C so that the locking lever 44 is reliably turned without obstructing the turning motion of the locking/unlocking output lever 67.

Double Locking of Door

When the driver leaves the vehicle, he holds the vehicle door in the locked state. For preventing the vehicle from being stolen, the vehicle door can be kept away from the unlocked state even if the lock knob is operated.

Figure 9:
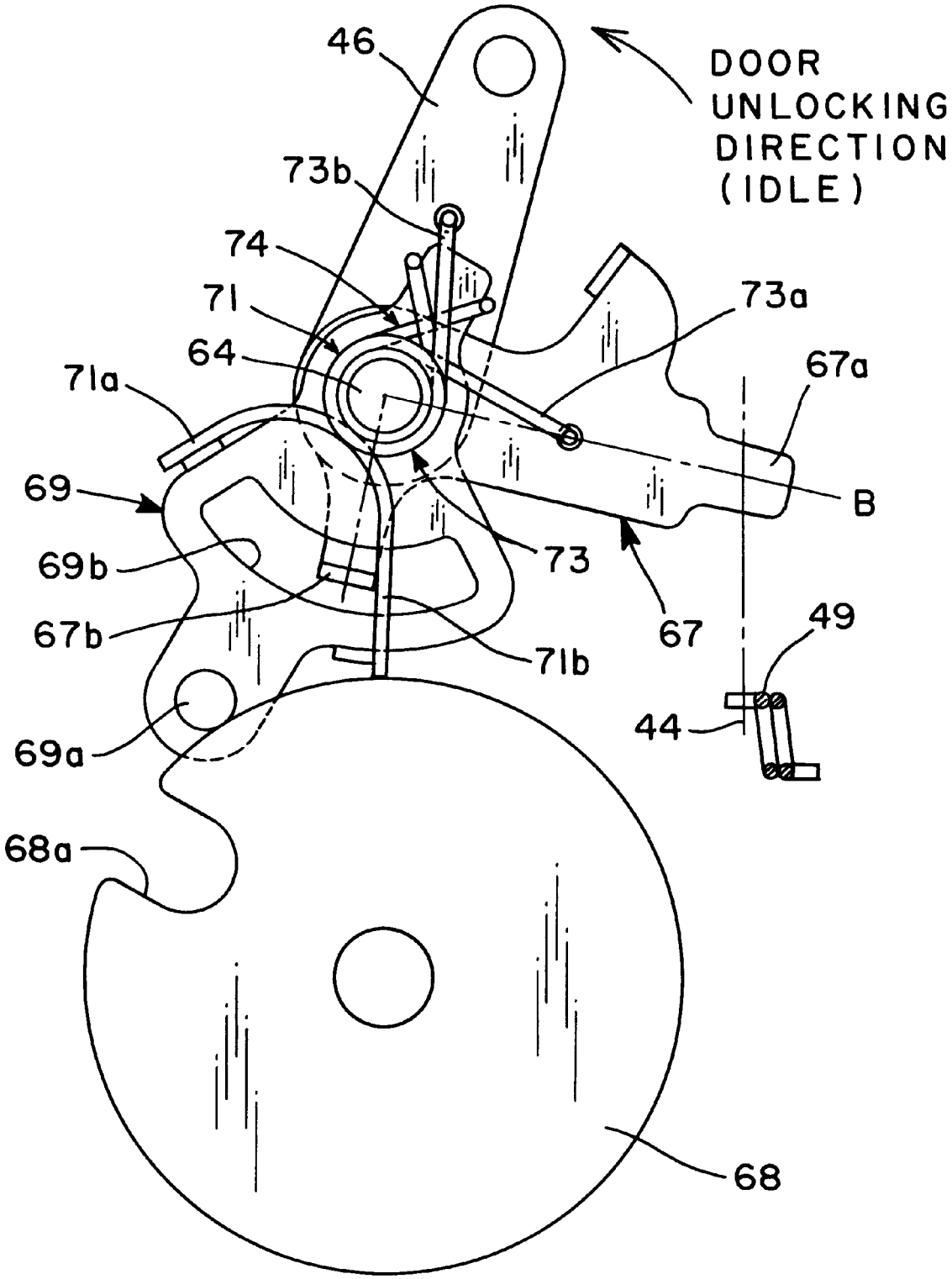
FIG. 9 is an explanatory diagram showing a double locking action of the door lock assembly according to the invention.

The motor 62 is kept stopped in the state of FIG. 6 in which the locking/unlocking output lever 67 of the actuator 6 is positioned at the locked position A and before the motor 62 is reversed. As a result, the action lever 69 does not restore the neutral position, but its pin 69*a* remains in abutment against the outer peripheral face of the cam 68 so that the flange portion 67*b* of the locking/unlocking output lever 67 remains in contact with the other end 71*b* of the spring 71. As shown in FIG. 9, therefore, even when the lock knob is operated to turn the inside locking lever 46 in the door unlocking direction, the locking/unlocking output lever 67 is preventing form turning in the unlocking direction by the other end 71*b* of the spring 71 so that it neither follows the inside locking lever 46 nor turns in the door unlocking direction, because the urging force 71 is set stronger than that of the spring 73. In other words, the inside locking lever 46 turns idly, namely, does not strike any part and the locking/unlocking output lever 67 is held in the locked position A so that the vehicle door retains in the locked state.

Figure 10:
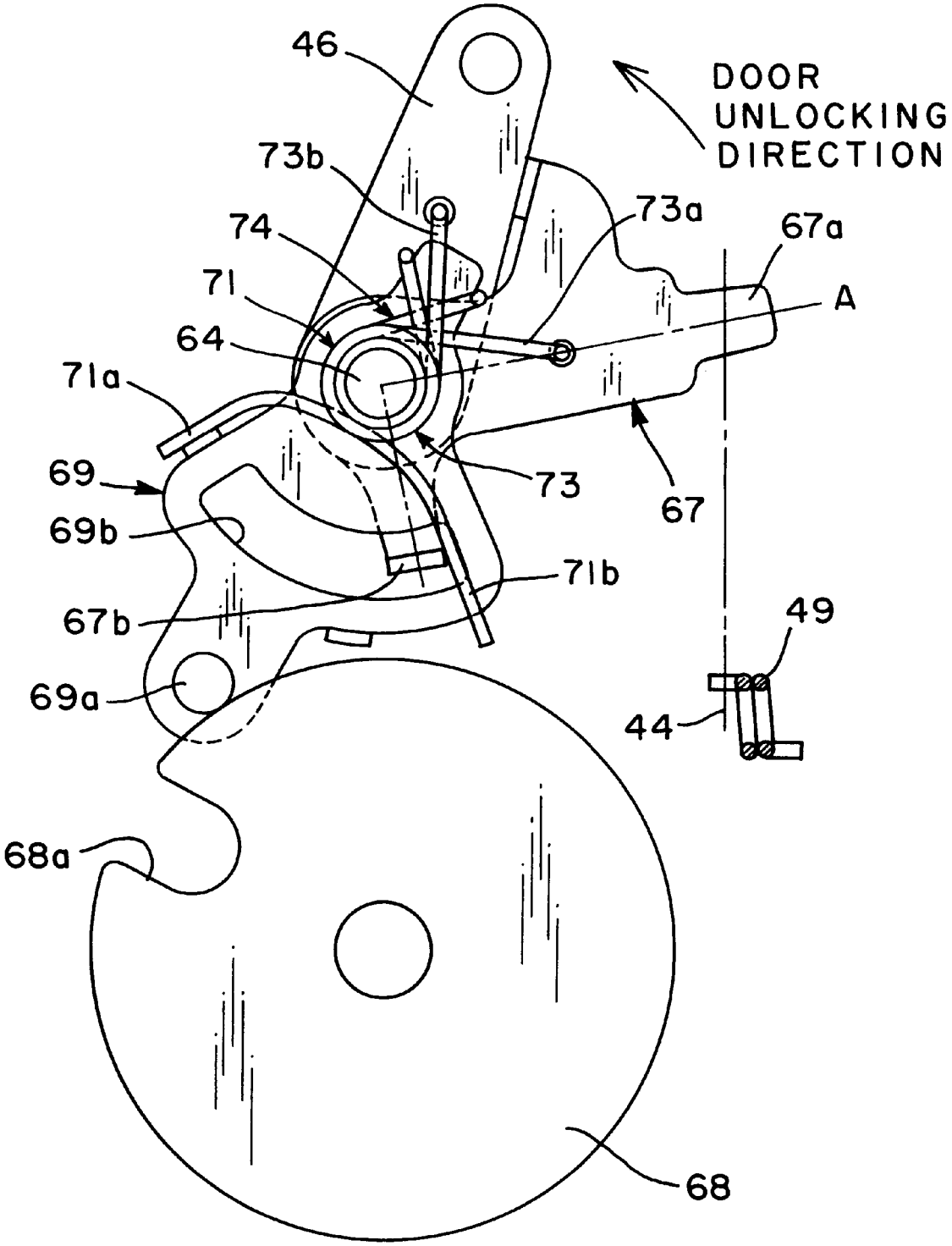
FIG. 10 is an explanatory diagram showing a double locking action of the door lock assembly according to the invention.

When the motor 62 is reversed, the vehicle door returns from the double locked state to the locked state. When the motor 62 is not reversed at this time because of a trouble or the like, the vehicle door can be forcibly brought out of the double locked state into the open state by operating the key cylinder mechanism. When the key cylinder mechanism is operated to turn the locking lever 44 directly in the door unlocking direction, an operating force stronger than the urging force of the spring 71 is applied from the locking lever 44 to the locking/unlocking output lever 67 so that the locking/unlocking output lever 67 turns in the door unlocking direction to the unlocked position B with respect to the action lever 69 while warping the other end 71*b* of the spring 71, as shown in FIG. 10. As a result, the vehicle door is forcibly released from the double locked state and brought into the unlocked state. Here if the operation of the key cylinder mechanism is interrupted when the vehicle door is released from the double locked state by operating the key cylinder mechanism, the locking/unlocking output lever 67 is returned from the unlocked position B to the locked position A by the urging force of the spring 71 so that the vehicle door restores the double locked state. As a result, when the vehicle door is forcibly released from the double locked state by the key cylinder mechanism, the outside handle may be operated to bring the vehicle door into the open state while continuing the operation of the key cylinder mechanism.

Opening/Closing of Door

FIG. 2 shows the latch mechanism 3 in the open state of the vehicle door. When the vehicle door is closed in this state, the stroker 34 is received in the U-shaped groove 33*b* of the latch 33 to turn the latch 33 counter-clockwise (or in the door closing direction) of FIG. 2 thereby to bring the first engagement tooth 33*c* of the latch 33 and the ball 32 into engagement. As a result, the vehicle door comes into the completely closed state.

In the unlocked state and the completely closed state of the vehicle door, when the outside handle is operated, the open lever 43 is turned counter-clockwise (or in the door opening direction) of FIG. 1 so that the engagement projection 45*b* of the slide bushing 45 comes into engagement with the engagement flange 42*b* of the second lift lever 42 to turn the second lift lever 42 counter-clockwise (or in the door opening direction) of FIG. 1. By this turn of the second lift lever 42 in the door opening direction, the engagement flange 42*a* of the second lift lever 42 comes into engagement with the first lift lever 41 so that the first lift lever 41 turns counter-clockwise (or in the door opening direction) of FIG. 1. As a result, the pawl 32 of the latch mechanism 3 and the first engagement tooth 33*c* of the latch 33 are disengaged to bring the vehicle door into the open state. When the inside handle is operated, on the other hand, the cancel lever 53 turns counter-clockwise (or in the door opening direction) of FIG. 1 through the inside lever so that the second lift lever 42 turns in the door opening direction through the rod 56. By this turn of the second lift lever 42 in the door opening direction, the engagement flange 42*a* of the second lift lever 42 comes into engagement with the first lift lever 41 so that the first lift lever 41 turns counter-clockwise (or in the door opening direction) of FIG. 1. As a result, the pawl 32 of the latch mechanism 3 and the first engagement tooth 33*c* of the latch 33 are disengaged to bring the vehicle door into the open state.

Closing of Door

Figure 11:
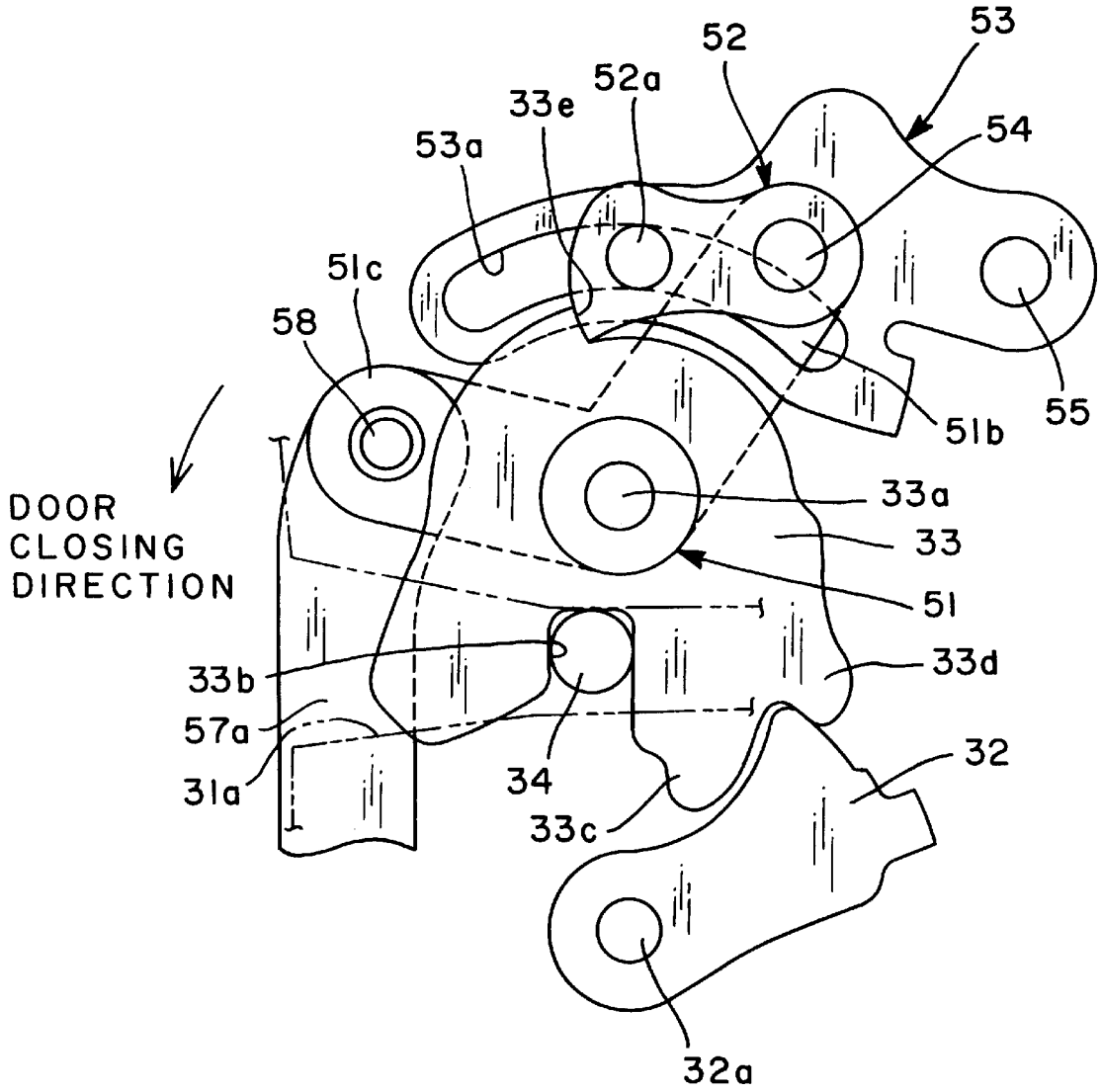
FIG. 11 is an explanatory diagram showing a closing action of the door lock assembly according to the invention.
Figure 12:
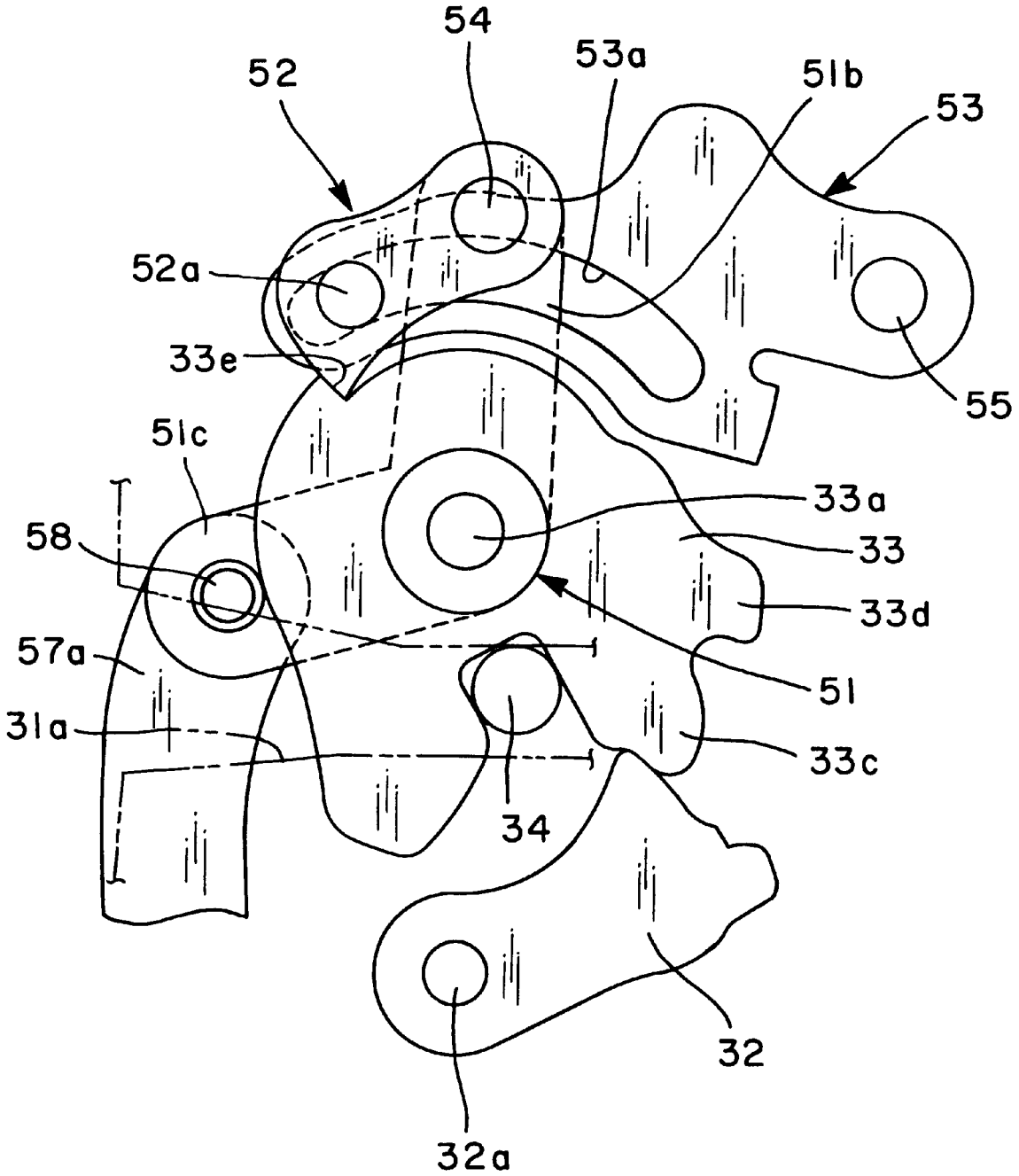
FIG. 12 is an explanatory diagram showing a closing action of the door lock assembly according to the invention.

When the closing force to close the vehicle door is so weak that the first engagement tooth 33*c* of the latch 33 fails to engage with the pawl 32 but the second engagement tooth 33*d* of the latch 33 remains in engagement to leave the vehicle door in a partially open state, the motor 62 rotates in the other direction so that the closing output lever 66 of the actuator 6 turns by a predetermined angle (e.g., clockwise about 100 degrees from the position at which the action lever 69 is at the initial position C, as shown in FIG. 14) through the reduction gear structure 65 to turn the close lever 51 counter-clockwise (or in the door closing direction) of FIG. 11 through the rod 57. As a result, the release pawl 52 is guided by the slot 53*a* of the cancel lever 53 to move into engagement with the pawl 33*e* of the latch 33. As the closing output lever 66 is further turned by a predetermined angle (e.g., about 120 degrees, as shown in FIG. 14) by the rotation of the motor 62 in the other direction to turn the close lever 51 in the door closing direction, the latch 33 is pushed by the release pawl 52 to turn in the door closing direction by the engagement between the release pawl 52 and the pawl 33*e* until the first engagement tooth 33*c* of the latch 33 comes into engagement with the pawl 32, as shown in FIG. 12. As a result, the vehicle door comes into the completely closed state. After this, the motor 62 is reversed to return the closing output lever 66 and the close lever 51 to the initial positions.

Figure 13:
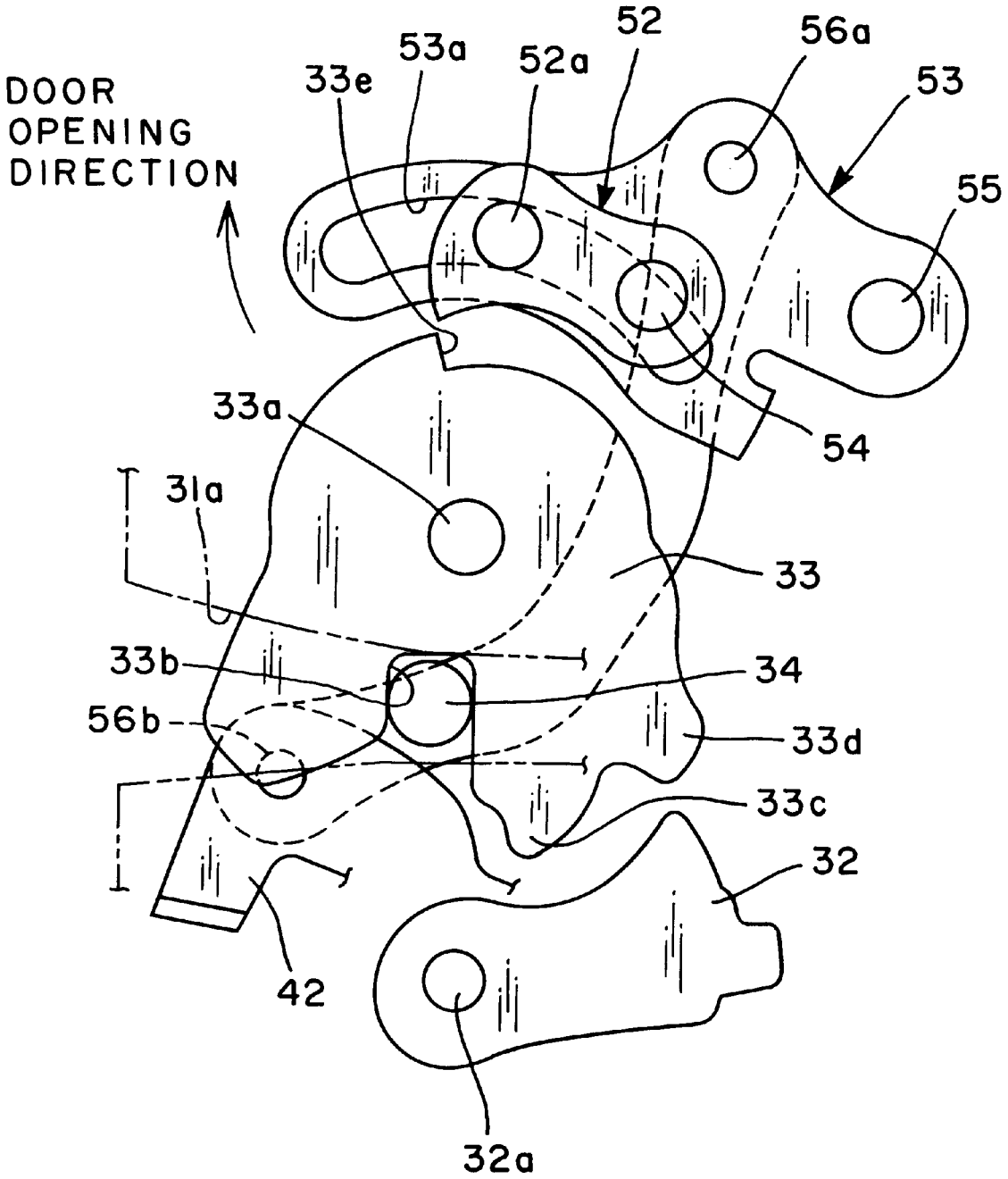
FIG. 13 is an explanatory diagram showing a closing action of the door lock assembly according to the invention.

When the outside handle is operated while the release pawl 52 turning the latch 33, the open lever 43 turns in the door opening direction so that the second lift lever 42 turns in the door opening direction through the slide bushing 45. As the second lift lever 42 turns in the door opening direction, the cancel lever 53 turns clockwise (or in the door opening direction) of FIG. 13 through the rod 56. By the inserted relation between the slot 53*a* and the pin 52*a*, the release pawl 52 is then turned clockwise of FIG. 13 to come out of engagement with the pawl 33*e* of the latch 33. As a result, the door closing operation is interrupted. When the inside handle is operated, on the other hand, the cancel lever 53 turns in the door opening direction, as shown in FIG. 13, so that the release pawl 52 is turned clockwise of FIG. 13 by the inserted relation between the slot 53*a* and the pin 52*a* to come out of engagement with the pawl 33*e* of the latch 33. As a result, the door closing operation is interrupted. Here, as this door closing operation is interrupted, the motor 62 is reversed to return the closing output lever 66 and the close lever 51 to the initial positions.

When the pawl 32 comes into engagement with the first engagement tooth 33*c* of the latch 33, it turns to ride over the first engagement tooth 33*c* so that it turns the first lift lever 41 in the door opening direction. This turning motion of the first lift lever 41 is directed away from the second lift lever 42 and is not transmitted to the second lift lever 42 so that the second lift lever 42 turns in the door opening direction and the cancel lever 53 turns in the door opening direction, that is, the closing operation is not interrupted.

Here, in the door locking/unlocking operation by the motor 62, the closing output lever 66 is also turning. In the door closing operation, on the other hand, the locking/unlocking output lever 67 is also turning. As shown in FIG. 14, however, the closing operation is started when the locking/unlocking output lever 67 turns by a predetermined angle (of about 100 degrees) across the unlocked position B so that it is not effected even if the closing output lever 66 turns in the door locking/unlocking operations. In the closing operation, moreover the locking/unlocking output lever 67 is positioned, even turned, at the unlocked position B so that the vehicle door does not come into the locked state.

According to the invention, the drive mechanism is so shared that the single motor can drive the locking/unlocking mechanism and the closer mechanism. As a result, the entire assembly can be made smaller than the related art so that it can be arranged in compact in the vehicle door while reducing the weight and lowering the cost.

As many apparently widely different embodiments of the present invention can be made without departing from the spirit and scope thereof, it is to be understood that the invention is not limited to the specific embodiments thereof except as defined in the appended claims.

What is claimed is:

1. A door lock assembly for automotive vehicles comprising:

a latch mechanism having a latch and pawl to hold a vehicle door in a closed position when the latch and pawl are engaged;

a closer mechanism for bringing the vehicle door from a partially closed state to a completely closed state through operation of the latch mechanism;

a locking/unlocking mechanism for bringing said vehicle door into a locked state to prohibit operation of the latch mechanism and into an unlocked state to permit operation of the latch mechanism; and a drive mechanism including a single motor acting as a drive source for actuating said closer mechanism and said locking/unlocking mechanism;

said drive mechanism including:

a first output lever associated with said locking/unlocking mechanism for reciprocating between a locked position, in which said vehicle door is in the locked state, and an unlocked position in which said vehicle door is in the unlocked state;

a second output lever associated with said closer mechanism for reciprocating between an initial position and an active positions in which said vehicle door is brought from said partially closed state to said completely closed state; and a rotary member for reciprocating said first output lever between said locked position and said unlocked position and for reciprocating said second output lever between said initial position and said active position, wherein said rotary member rotates over a desired angle of rotation, at which said first output lever is at said unlocked position, to move said second output lever from said initial position to said active position and said rotary member rotates in a direction, at which said first output lever is at said locked position, which is opposed to the direction when said closer mechanism is operated.

2. A door lock assembly for automotive vehicles comprising:

a latch mechanism having a latch and pawl to hold a vehicle door in a closed position when the latch and pawl are engaged;

a closer mechanism for bringing the vehicle door from a partially closed state to a completely closed state through operation of the latch mechanism;

a locking/unlocking mechanism for bringing said vehicle door into a locked state to prohibit operation of the latch mechanism and into an unlocked state to permit operation of the latch mechanism; and a drive mechanism including a single motor acting as a drive source for actuating said closer mechanism and said locking/unlocking mechanism;

said drive mechanism including:

a first output lever associated with said locking/unlocking mechanism for reciprocating between a locked position, in which said vehicle door is in the locked state, and an unlocked position in which said vehicle door is in the unlocked state;

a second input lever associated with said closer mechanism for reciprocating between an initial position and an active position in which said vehicle door is brought from said partially closed state to said completely closed state; and a rotary member for reciprocating said first output lever between said locked position and said unlocked position and for reciprocating said second output lever between said initial position and said active position;

said rotary member having a groove formed in its outer peripheral face, and said first output lever having an engagement pin formed thereon for coming into and out of engagement with said groove and for coming into abutment against said outer peripheral face when disengaged from said groove.

3. A door lock assembly for automotive vehicles comprising:

a base member adapted to be mounted on a vehicle door and having a latch mechanism for holding the vehicle door in a closed position when a latch and a pawl are completely engaged;

drive means attached to said base member and having a single electric motor for transmitting a rotational torque to a rotary member which is supported on a first output shaft and an action lever which is supported on a second output shaft, said rotary member being engaged with and disengaged from said action lever when said rotary member is rotated by said electric motor;

a closer mechanism for bringing a vehicle door from a partially closed state to a completely closed state and having a close lever which is connected to a closing output lever fixedly secured to said first output shaft; and a lever mechanism capable of opening and closing the vehicle door by an operation of said latch mechanism and having a locking lever which is connected to said action lever having a locking/unlocking output lever fixedly connected to said second output shaft;

reciprocating movements of said closing output lever and said locking/unlocking output lever in the range of a predetermined angle being performed by an actuation of said drive means to take at leas tone of door completely closed, door locked and door unlocked positions, said rotary member being of a circular shape and having a groove formed on its peripheral surface, said action lever being rotatably supported on said second output shaft and having a pin engageable with said groove depending upon a degree of the rotation of said rotary member, said action lever being operatively connected to said locking/unlocking output lever through a biasing means.

4. A door lock assembly according to claim 3, wherein said pin is slidable along the outer peripheral surface of the rotary member and said rotary member rotates over a desired angle of rotation, at which said locking/unlocking output lever is at the unlocked position, to move said closing output lever from an initial position to an active position wherein the vehicle door is brought from the partially closed state to the completely closed state.

5. A door lock assembly according to claim 3, wherein said drive means includes a housing in which said single motor is housed and said shafts are supported, and a reduction gear arrangement arranged between said single motor and said rotary member.

* * * * *